United States Patent [19]

Lehmann et al.

[11] Patent Number: 4,658,432

[45] Date of Patent: Apr. 14, 1987

[54] CONTAINER FOR BULK MATERIAL

[75] Inventors: Rolaf Lehmann; Sven Burmeister, both of Elmshorn, Fed. Rep. of Germany

[73] Assignee: Lolift Verwaltungs GmbH, Elmshorn, Fed. Rep. of Germany

[21] Appl. No.: 833,648

[22] Filed: Feb. 25, 1986

[30] Foreign Application Priority Data

Feb. 26, 1985 [DE] Fed. Rep. of Germany ... 8505491[U]

[51] Int. Cl.[4] ..... B65D 33/02; B65D 33/14; B65D 88/16; B65D 90/02

[52] U.S. Cl. ..... 383/20; 383/6; 383/22; 383/41; 383/107; 383/117; 383/119; 383/121; 383/906

[58] Field of Search ..... 383/6, 17, 20, 22, 24, 383/41, 107, 104, 117, 119, 121, 122, 906, 908, 7; 112/262.1

[56] References Cited

U.S. PATENT DOCUMENTS

| | | | |
|---|---|---|---|
| 1,914,113 | 6/1933 | Eaton | 383/119 X |
| 2,298,419 | 10/1942 | Salfisberg | 383/119 X |
| 3,074,617 | 1/1963 | Kindseth et al. | 383/104 |
| 4,010,784 | 3/1977 | Nattrass et al. | 383/17 |
| 4,207,937 | 6/1980 | Sandeman et al. | 383/18 |
| 4,224,970 | 9/1980 | Williamson et al. | 383/41 X |
| 4,300,608 | 11/1981 | Cuthbertson | 383/22 X |
| 4,301,848 | 11/1981 | Beaven et al. | 383/20 |
| 4,307,764 | 12/1981 | Nattrass | 383/17 |
| 4,362,199 | 12/1982 | Futerman | 383/17 X |
| 4,479,243 | 10/1984 | Derby et al. | 383/24 |

FOREIGN PATENT DOCUMENTS

| | | | |
|---|---|---|---|
| 140346 | 5/1985 | European Pat. Off. | 383/117 |
| 7809415 | 8/1979 | Netherlands | 383/6 |

*Primary Examiner*—William Price
*Assistant Examiner*—Sue A. Weaver
*Attorney, Agent, or Firm*—Flynn, Thiel, Boutell & Tanis

[57] ABSTRACT

A large-sized transportation container for the transport of material in bulk comprises a side wall structure that is formed with four equally sized, substantially rectangular wall portions each of which is a separate cut-up of a woven fabric. The wall portions are interconnected at mutually overlapping edge portions by means of four corner seams which are each stitched with a zigzag-stitch. With this side wall structure a bulk container is obtained which has a factor of safety in respect to the forces acting on the wall which is six times higher than the safety factor of the known containers.

6 Claims, 3 Drawing Figures

CONTAINER FOR BULK MATERIAL-

FIELD OF THE INVENTION

This invention relates to a large-sized transportation container for the transport of materials in bulk, particularly of materials of a generally comminuted or disintegrated nature.

BACKGROUND ART

Bulk containers of the kind as herein referred are generally made of a fabric material of such an adequate strength that when these containers which are usually filled with a load in the range of at least one ton are handled and subjected to impulsive forces by the lifting means used such as a crane or a fork lift truck no unpredicted failure of the container will occur. For allowing the handling of such heavy loads these bulk containers are usually provided with four lifting loops of such a size as to be engageable over the hook of a crane or the forks of a fork lift truck.

In German Utility Model No. 78 30 440 a prior art bulk container is described as comprising a side wall that is formed with a single, substantially rectangular cut-up of a high tenacity synthetic fibre woven fabric which is double stitched together along two cut edges extending in the direction either of the warp threads or of the weft threads of the material. This double stitch seam which accordingly forms an interconnection seam for the single cut-up of the woven fabric affects the safety factor in respect to the so-called bursting pressure of a fully loaded container so that the side wall structure of this known bulk container is provided with four additional double stitch seams forming four corner seams that accordingly subdivide the side wall structure of the container into two pairs of oppositely parallel wall portions whereby said interconnecting seam is arranged in the middle of one of these wall portions. Each of the corner seams further secures the two legs of a coordinated U-shaped lifting loop to the side wall structure to which opposite of the lifting loops a separate bottom is stitched. With this known bulk container the four corner seams provide a safety factor in respect to the bursting pressure that with a dropping test from a dropping height of 120 centimeter the container when being filled with a load of about 1250 kilograms will not be damaged.

Another prior art bulk container is described in German Utility Model No. 83 31 441.5 as comprising also a single cut-up of a woven fabric for forming its side wall structure with the provision of an interconnection seam for two of its cut edges which instead of being double stitched is being zigzag-stitched by means of a single needle sewing machine. This zigzag-stitched seam provides a safety factor in respect to the bursting pressure of such a value that with this also known bulk container no additional corner seams are needed for obtaining an overall strength corresponding to the strength of a container the side wall structure of which comprises a portion length of a seamless round material as woven at the same time with more tightly packed threads of a comparable superior strength. This kind of a container which further is also provided with a separate bottom as stitched to the side wall structure by means of an oversew stitch and also with four U-shaped lifting loops which through their legs are each secured to the side wall structure by means of additional zigzag-stitches of a short length together with a small cutup of the same fabric may therefore be produced with less costs than all others so far known bulk containers of the same kind.

This invention deals with the object of providing a bulk container of the general kind as above referred which in comparison with the so far known embodiments provides at least the same factor of safety in respect to the bursting pressure under comparable conditions for said dropping test and in addition provides an improved factor of safety in respect to the forces which mainly in a vertical direction are acting on the side wall structure when these bulk containers by means of their lifting loops are engaged over the hook of a crane or the forks of a fork lift truck for their filling and transportation when loaded with bulk material.

SUMMARY OF THE INVENTION

A bulk container according to the main feature of the present invention is provided with a side wall structure that is formed with four equally sized, substantially rectangular wall portions which each comprise a cut-up of a woven fabric, these wall portions being arranged in a mutually overlapping manner at adjacent vertically extending edge portions and being interconnected by four corner seams which are each stitched with a zigzag-stitch that also secures the two legs of a coordinated U-shaped lifting loop to the side wall structure of the container.

With the use of a synthetic fiber woven fabric having the usual tensile strength of at least about 197 N/cm$^2$ for each of the four wall portions a large-sized transportation container for the transport of materials in bulk is accordingly provided which in comparison with both known types of bulk containers as described above now provides a safety factor in respect to the forces acting on the side wall structure which is more than six times higher than the comparable safety factor of these known containers whereby this improved safety factor also contributes to a substantial improvement of the factor of safety in respect to the bursting pressure of the inventive bulk container under comparable conditions for the dropping test.

DESCRIPTION OF THE PREFERRED EMBODIMENT

Figure 1:
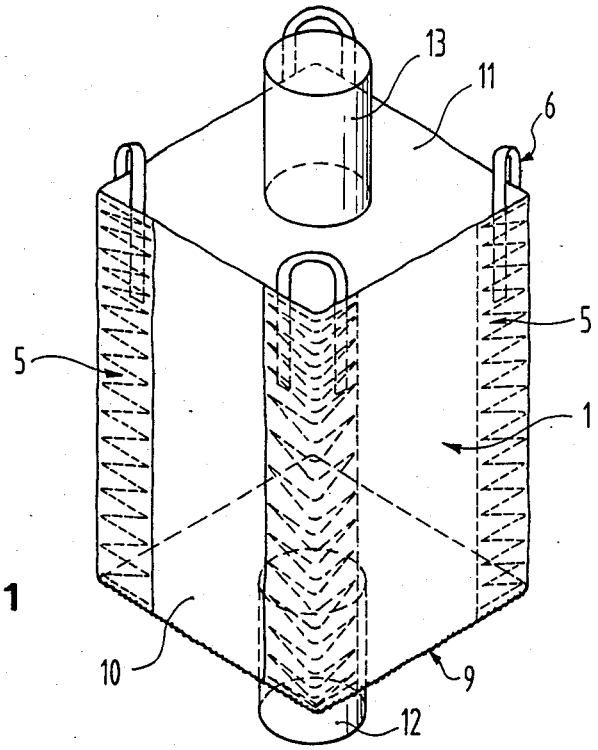
FIG. 1 is a diagrammatic perspective view of the bulk container.

The bulk container of FIG. 1 is intended to contain a substantial quantity of material in the range of normally more than one ton which provides such a large-sized transportation container with a filling volume of about one cubic meter. The container is provided with a side wall structure 1 which is subdivided into four wall portions or panels that are arranged in two pairs of oppositely parallel wall portions.

Each of these four wall portions or panels is provided by a separate cut-up of a high-tenacity synthetic fiber woven fabric for example of the type used for vehicle seat belts which material in general is woven of polypropylene or terylene providing a tensile strength of at least about 197 N/cm$^2$. Each cut-up is thereby provided with a substantially rectangular shape with two opposite cut edges extending in the direction of the warp threads of the fabric and the two remaining cut edges extending in the direction of the weft threads. With each cut-up of the fabric the two shorter cut edges determine the height of the container whereas the two larger cut edges determine the width of the wall portion which is formed by the particular cut-up in comparison with which, however, these longer cut edges are provided with a surplus length for obtaining an overlap of about 30 to about 40 centimeters at each corner of the container in respect to the adjacent wall portions as will be explained later in more detail. The shorter cut edges of each cut-up may be provided with a hemming over a width of for example about two centimeters to prevent a tearing of the fabric at these edges at which the cut-ups receive a mutual interconnection.

Figure 2A:
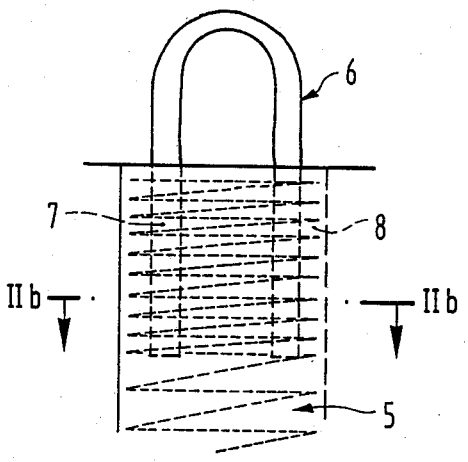
FIG. 2*a* is a fragmentary view of a corner seam and its coordinated lifting loop of the bulk container according to FIG. 1.
Figure 2B:
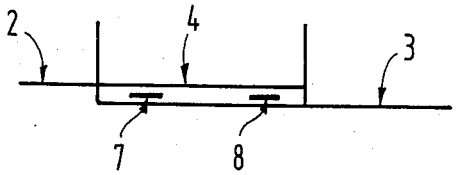
FIG. 2*b* is a diagrammatic sectional view of the corner seam along the line II*b*—II*b* of FIG. 2*a*.

At each corner of the container the two coordinated wall portions or panels which are formed by two respective cut-ups as explained before are arranged in a mutually overlapping manner. As shown by the sectional view of FIG. 2*b* two respective cut-ups 2 and 3 are accordingly provided at their vertically extending cut edges with an overlap 4 in the preferred range of about 30 to about 40 centimeter so that in comparison with the width of the two wall portions which are formed by these two cut-ups 2, 3 the longer cut edges of the same then are provided with a surplus length corresponding to the double value of this overlap. At this overlap 4 the two cut-ups 2, 3 are also stitched together by means of a zigzag-stitch as obtained with an ordinary single needle sewing machine so that the container as shown in FIG. 1 is provided in each of its four corners with a corner seam 5 each of which accordingly interconnects two adjacent wall portions. In each of these four corners of the container there is further provided a substantially U-shaped lifting loop 6 with its bight bridging the coordinated corner portion. The two spaced legs 7 and 8 of each lifting loop 6 on the other side extend into the interspace between the coordinated overlapping edge portions of their adjacent wall portions as clearly shown by the sectional view of FIG. 2*b* and these two legs 7, 8 are secured to the side wall structure 1 of the container by means of an upper portion of the coordinated corner seam 5. This upper portion of each corner seam 5 preferably is provided over a length of about 25 to about 40 centimeters with mutually closer zigzag-stitches in comparison with the remaining length of the seam so that an interspace of for example about 5 centimeters is provided for the zigzag-stitches of this upper portion to thereby obtain the desired fast connection of the legs 7, 8 of each lifting loop 6 to the side wall structure 1 of the container. The interspace of the zizag-stitches of the remaining length of each corner seam 5 in this example then can measure approximately 10 centimeters.

The container having in accordance with the present invention the before described structure of its side wall 1 is in addition only still provided with a substantially square bottom 10 which is stitched to the side wall structure 1 by means of an oversew stitch 9. The container can further be provided with a separate lid 11 as also stitched to the side wall structure 1 whereby FIG. 1 further shows that both the bottom 10 and this lid 11 are still provided at a central portion with a spout 12 for emptying the container of its contents and a spout 13, respectively, allowing the filling of the container. As known for those skilled in the art such large-sized transportation containers instead of the lid 11 with the top spout 13 may also be provided with a drawstring closure without departing from the scope of the novel concept of this invention in respect to which it accordingly will be apparent that many modifications and variations may be implemented.

What is claimed is:

1. A large-sized transportation container for the transport of materials in bulk, comprising:

a side wall structure that is formed with four equally sized, substantially rectangular wall portions, each wall portion being a separate cut-up of a high tenacity synthetic fiber woven fabric and having two opposite, cut edges extending in the direction of the warp threads of the fabric whereas the two remaining cut edges extend in the direction of its weft threads;

four corner seams being each stitched with a zigzag-stitch and interconnecting in pairs said wall portions at mutually overlapping, vertically extending edge portions that each comprise one corresponding cut edge of said one pair of opposite, cut edges of a respective cut-up so that with these four corner seams a side wall structure having two pairs of oppositely parallel wall portions or panels is being formed;

four substantially U-shaped lifting loops having each a bight and two spaced legs and being each secured to said side wall structure by means of an upper portion of a coordinated corner seam; and a substantially square bottom being stitched to said side wall structure opposite of said lifting loops.

2. A bulk container according to claim 1 wherein said mutually overlapping edge portions are each provided with an overlap in the range of about 30 to about 40 centimeters.

3. A bulk container according to claim 1 wherein the two legs of each lifting loop extend into the interspace between the coordinated overlapping edge portions of their adjacent wall portions or panels so that their bight bridges a coordinated corner of the container.

4. A bulk container according to claim 1 wherein the two legs of each lifting loop are stitched to said side wall structure with mutually closer zigzag-stitches than the stitches of the remaining length of the coordinated corner seam.

5. A bulk container according to claim 4 wherein the two legs of each lifting loop are stitched to the side wall structure over a length in the range of about 25 to about 40 centimeters with an interspace of the zigzag-stitches of about 5 centimeters in comparison with an interspace of about 10 centimeters of the zigzag-stitches along the remaining length of the corner seam.

6. A bulk container according to claim 1 wherein said bottom is being stitched to said side wall structure by means of an oversew stitch.

* * * * *